United States Patent [19]

Parish et al.

[11] Patent Number: 4,519,773

[45] Date of Patent: May 28, 1985

[54] DUAL CANNISTER GAS HOUSING

[75] Inventors: Mark G. Parish, Brown Deer; Roy M. Rulseh, Milwaukee, both of Wis.

[73] Assignee: Aqua-Chem, Inc., Milwaukee, Wis.

[21] Appl. No.: 469,583

[22] Filed: Feb. 25, 1983

[51] Int. Cl.[3] ..... F23C 5/28; F23N 1/00

[52] U.S. Cl. ..... 431/176; 431/12; 431/175; 431/285

[58] Field of Search ..... 431/177, 175, 176, 178, 431/179, 278, 284, 285, 12; 239/422, 423

[56] References Cited

U.S. PATENT DOCUMENTS

| | | | |
|---|---|---|---|
| 791,430 | 5/1905 | McCarty | 431/178 |
| 1,301,044 | 4/1919 | Dunham | 431/12 |
| 2,285,287 | 6/1942 | Krogh | 431/12 |
| 2,822,864 | 2/1958 | Black | 431/175 |
| 3,049,168 | 8/1962 | Litwinoff | 431/12 |
| 3,684,186 | 8/1972 | Helmrich | 239/423 X |
| 3,734,675 | 5/1973 | Osburn | 431/12 |

FOREIGN PATENT DOCUMENTS

| | | | |
|---|---|---|---|
| 184988 | 9/1963 | Sweden | 239/422 |

*Primary Examiner*—Samuel Scott
*Assistant Examiner*—Kenichi Okuno

[57] ABSTRACT

The dual cannister gas housing of the present invention permits combustion of two separate gases of different heating values for industrial applications. The housing includes a first annular chamber surrounding a combustion zone, the first chamber receiving a first gas. Holes in the inner wall of the chamber permit entry of the first gas into the combustion zone. A second chamber surrounds the first chamber and receives a second gas. Tubes connect the second chamber to the combustion zone, the tubes passing through the first chamber to prevent mixing of gas. The number and size of the tubes and holes are selected for each application to insure proper entry velocity and pressure drop for the first and second gases.

9 Claims, 3 Drawing Figures

DUAL CANNISTER GAS HOUSING

BACKGROUND OF THE INVENTION

1. Field of the Invention

The present invention relates generally to burners and in particular to a dual cannister gas housing for the combustion of two separate gases having different heating values.

2. Description of the Prior Art

Gases of relatively low heating value are becoming increasingly available. For example, commercial supplies of anaerobic digestion gas, sanitary landfill gas and coke oven gas are now available and the utilization of such gases is highly desirable in times of increasing energy costs. Because such gases have a lower heating value per unit of volume than more conventional fuels, such as natural gas, a higher quantity thereof is typically required to satisfy the heat input requirements of conventional burner equipment. To realize the commercial value of such gases, one of two approaches may be used. First, gas pressure can be increased. This approach is usually limited by the pressure from the supply source of the low heating value gas. In many instances, there simply is insufficient pressure to supply the volume of gas required. Second, the pressure can be maintained at a low level and the burner housing orifices can be increased in area. This approach is also limited by the fact that once orifice size is increased sufficiently to utilize the lower heating value gas, if it is desired to revert back to the higher heating value gas, the entry velocity and pressure drop thereof will be inadequate for proper combustion.

It would be highly desirable to have the capability of burning such low heating value gases in a system which also burns higher heating value gases, such as natural gas. At the same time, it would be highly desirable to be able to regulate gas flow velocity and pressures to insure proper combustion of the gas mixture.

OBJECTS AND SUMMARY OF THE INVENTION

It is a primary object of the present invention to provide a gas housing for intimately mixing and burning two gases having different heating values.

Another object of the present invention is to provide a gas housing for mixing and burning two gases having different inlet velocities.

A further object of the present invention is to provide a dual cannister gas housing in which mixing of two gases is prohibited until the gases are introduced into a combustion zone.

A still further object of the present invention is to provide a dual cannister gas housing which can be readily adapted to a wide variety of gas mixtures and which may be used with a wide variety of industrial burner applicators.

Yet another object of the present invention is to provide a dual cannister gas housing in which two gases may be fired separately or simultaneously.

How these and other objects of the invention are accomplished will be described in the following specification taken in conjunction with the drawings. Generally, however, the objects are accomplished in a gas housing which includes a generally cylindrical combustion chamber and which has a first annular chamber surrounding the combustion zone. A plurality of inlet holes couple this annular chamber to the combustion zone. A second annular chamber is located about the first annular chamber and tubes couple the second chamber to the combustion zone, the tubes passing through the first annular chamber and preventing mixture of the two gases except in the combustion zone. Separate gases, typically having different heating values and flow volumes, are supplied to the two annular chambers. The number and size of the tubes and the number and size of the inlet holes are varied depending on the characteristics of the gases for which the system is designed. Certain modifications and examples are also provided in the specification.

DESCRIPTION OF THE PREFERRED EMBODIMENT

Figure 1:
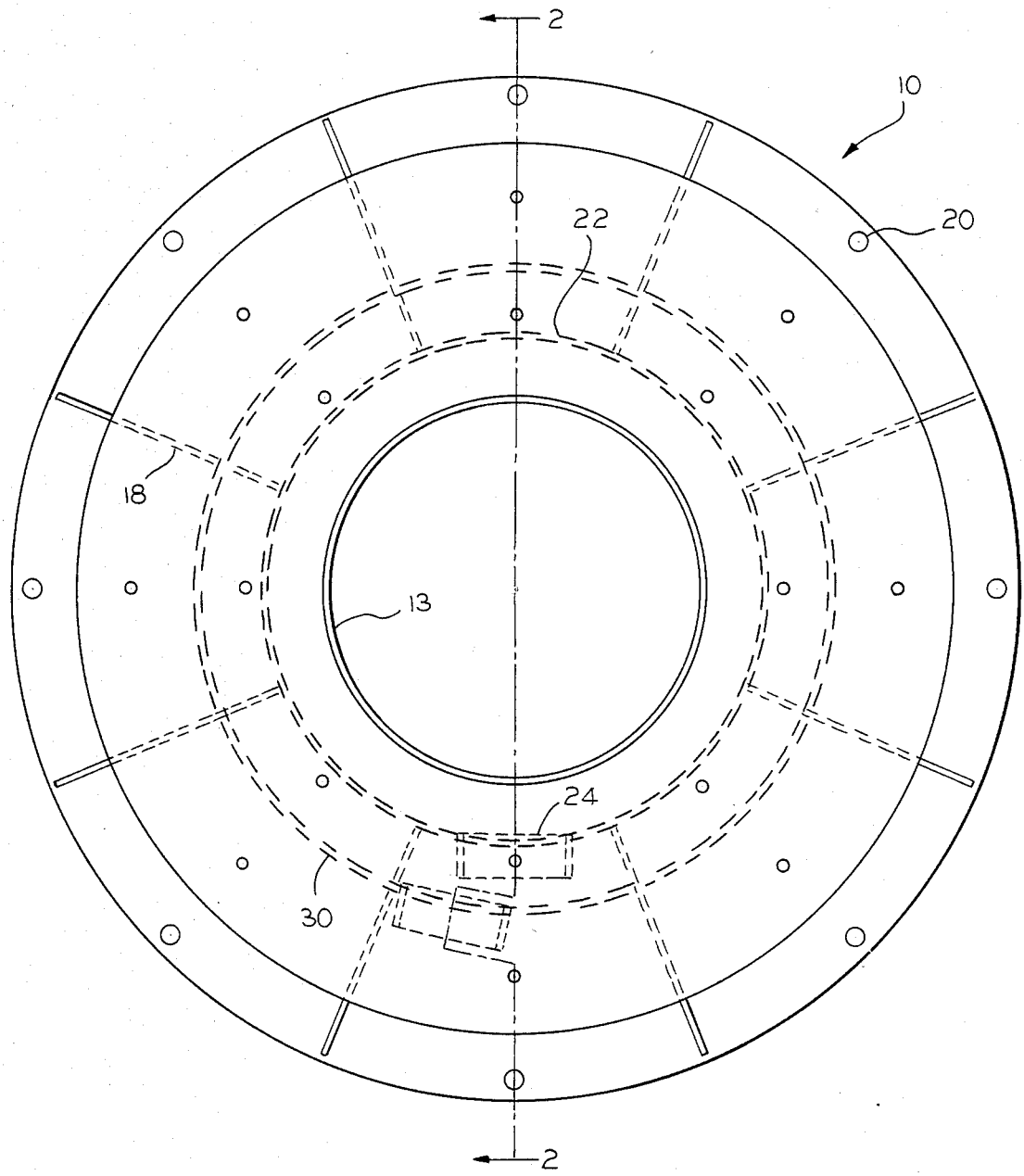
FIG. 1 is a front elevation view of a dual cannister gas housing according to the preferred embodiment of the present invention, with certain internal parts shown in phantom.

The preferred embodiment of the present invention will be described with reference to housing 10, a housing designed for a particular dual gas burning application. Following the description of the preferred embodiment, reference will be made to the components which would require modifications in the event other dual gas systems are encountered. Once the principles of the invention are understood, one skilled in the art could readily adapt housing to a wide variety of applications. It should be also mentioned at the outset that housing 10 may be used with a wide variety of boiler, incinerator or other industrial applications and that the invention is not to be limited to any specific end use. The end use apparatus is not shown, nor are conventional features, such as ignition systems, shown in the FIGS.

Housing 10 includes a combustion zone 12 defined by a burner tube 13. A conventional fan air diffuser system (not shown) is mounted through opening 15 at the left end of the housing to provide the necessary combustion air. Suitable controls known to the art may be provided for regulating the amount of air introduced. The right end of the burner tube 13 is open to the combustion chamber of the boiler, incinerator, etc. Tube 13 is constructed of metal.

Round mounting plate members 16 and 17 are welded to the left and right ends, respectively, of the burner tube 13 and each plate includes a central aperture to receive tube 13. The diameter of plate 17 is greater than that of plate 16, primarily for design reasons, and a plurality of gusset supports 18 are provided for structural integrity. The burner 10 is mounted in a suitable receptacle of the end use apparatus, such as by bolts 19. Mounting holes 20 are also illustrated on plate 17.

Housing 10 also includes a cylindrical wall 22 surrounding but spaced apart from tube 13 and defining a first annular gas introduction chamber 23. A gas inlet, which in the illustrated embodiment is a threaded half coupling 24, is provided so that a first gas may be introduced into chamber 23 and subsequently into the combustion zone 12. Chamber 23 extends about the entire length of tube 13 and is closed at its left end by plate 16 and at its right end by plate 17.

Housing 10 further includes a second cylindrical wall 30 located in a surrounding but spaced apart relationship to wall 22. Wall 18 extends about only a portion of the tube 13, i.e. the right portion thereof near the inlet to the end use apparatus. A second annular chamber 32 is thus provided and is defined by plate 17, walls 22 and 30 and by a circular wall 34 at the left end of second chamber 32. As with the first annular chamber, an inlet is provided to chamber 32 by a half coupling 36. Gas inlet pipes 40 and 42 are coupled respectively to fittings 24 and 36.

The next feature of the application to be described will be the means for providing communication between the first annular chamber 23 and the second annular chamber 32 and the combustion zone 12. Dealing first with chamber 32, gas leaves that chamber through a plurality of tubes 50 which are mounted to tube 13 and wall 22 and open respectively to chamber 32 and combustion zone 12. It will be appreciated from this description that gas entering chamber 32 from pipe 42 and passing through the tubes 50 is not allowed to mix with the gas from pipe 40 until it reaches the combustion zone 12.

In the illustrated embodiment thirty-five of tubes 50 are provided in an equal spacing around the combustion zone and the tubes have an inside diameter of 0.043 inches. It must be understood at this point in the description that the number of tubes and the diameter thereof can be widely varied as will be appreciated later in this description.

Figure 3:
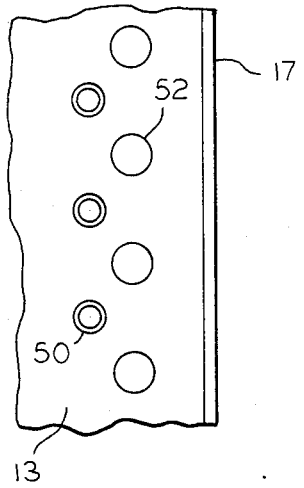
FIG. 3 is a sectional view taken along the line 3—3 of FIG. 2 showing the hole and tube configuration of the dual cannister gas housing of the preferred embodiment.

Gas communication from the first annular chamber 23 to combustion zone 12 is through a plurality of holes 52 within tube 13 and, as will be appreciated from FIG. 3, there are thirty-five of such holes having a diameter in the illustrated embodiment of 0.625 inches. As with the tubes 50, the number and size of the holes can be widely varied.

Figure 2:
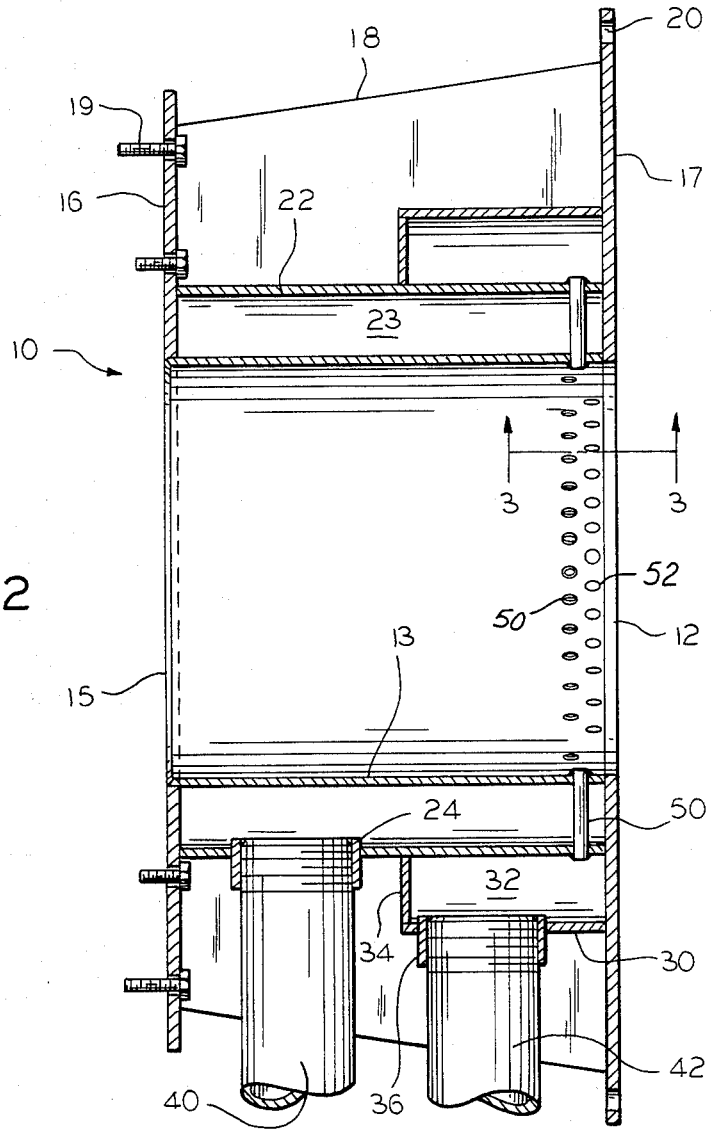
FIG. 2 is a sectional view taken along the line 2—2 of FIG. 1.

The arrangement of the tubes and holes in the preferred embodiment of the present invention is best illustrated in FIG. 3. The holes are not visible in FIG. 2. Both are equally spaced about the right end of burner tube 13, with a slight inward displacement of the tubes 50 with respect to the holes 52.

Now that the preferred embodiment of the present invention has been described, the operation of the dual cannister gas housing 10 can be explained. The illustrated embodiment is designed for a particular installation where two gas sources are available. A first gas source comprises natural gas (having a fuel value of about 1025 BTU) and the second gas source comprises landfill gas produced from a waste disposal operation (having a fuel value of about 550 BTU). The two gases are available under different supply pressures with the natural gas flowing at a regulated flow volume of 29,300 CFH (cubic feet per hour). The landfill gas has a regulated flow of about 53,000 CFH.

The two gases are introduced through pipes 40 and 42, and because of the different orifice sizes, the flow velocities at the combustion chamber are equalized. It will be obvious that if different flow velocities are encountered from dual gas sources, the housing of the present invention can be readily modified by designing the housing with a different number of holes and/or tubes or by varying the size of either.

It should also be recognized that the dual cannister gas housing of the present invention can be readily adapted to burn two gases either simultaneously or individually. For example, if one of the gases is readily available at a sufficient supply pressure and quantity for the end use combustion application, gas may be introduced through only one of the inlet pipes. Regulation of the supply pressure may be accomplished with conventional valve or pressure regulating devices (not shown). At times when that particular gas is not available in sufficient quantity, or should it be desirable to burn that gas in conjunction with a supply of a second gas, the supply pressure of the first gas can be reduced to compensate for the introduction of the second gas. Moreover, there may be times when the supply pressure and quantity of the second gas is sufficient by itself, in which case, the introduction of the first gas can be eliminated. Variation between the extremes will depend on the availability of the two gas sources at any particular time.

The dual cannister gas housing of the present invention thus permits the economical and efficient combustion of gases from two different sources at installations which previously had been unable to recognize the value of a low heating value gas source. While the present invention has been described in connection with a particular preferred embodiment, it is not to be limited by such a description, but is to be limited solely by the claims which follow.

We claim:

1. A burner device comprising a combustion zone and means for introducing two gases having different heating values thereto, said introducing means comprising:

a first chamber associated with said burner and having means for receiving a first gas and a first plurality of orifice means coupling said first chamber to said combustion zone;

a second chamber associated with said burner and surrounding said first chamber and having means for receiving a second gas and a second plurality of orifice means coupling said second chamber to said combustion zone, said second plurality of orifice means comprising a plurality of tubes passing through said first chamber and coupling said second chamber to said combustion zone thereby preventing mixing of said first gas and said second gas except in said combustion zone.

2. The burner set forth in claim 1 wherein said first chamber surrounds said combustion zone and a common wall is located therebetween and wherein said first plurality of orifice means comprise a plurality of holes in said common wall.

3. The burner set forth in claim 1 wherein said combustion zone is generally cylindrical and wherein said first and second chambers are generally annular.

4. The burner set forth in claim 3 wherein said first and second pluralities of orifice means are spaced apart about said combustion zone.

5. The invention set forth in claim 1 wherein the size of the openings of said first plurality of orifice means is different than the size of the openings of said second plurality of orifice means.

6. The invention set forth in claim 1 wherein the number of said first plurality of orifice means is different than the number of said second plurality of orifice means.

7. A burner housing for mixing and burning two gases having different heating values and different supply pressure requirements comprising a generally cylindrical burner tube having an outlet to a combustion chamber of a combustion apparatus, a first generally cylindrical and annular chamber surrounding said tube and having a common wall therebetween, a plurality of holes in said common wall, means for introducing a gas into said first annular chamber;

a second annular chamber surrounding said first annular chamber and means for introducing a second gas into said second annular chamber;

tube means coupling said second annular chamber to the outlet of said burner tube, said tube means passing through said first annular chamber;

the inside diameter of said tube means being different than the diameter of said holes.

8. The burner set forth in claim 7 wherein a plurality of said holes and said tube means are provided, said tube means and holes being generally equally spaced with respect to one another about said outlet of said burner tube.

9. A method for burning two separate gases having different heating values and different supply pressures in a combustion apparatus having a combustion zone defined by a wall comprising the steps of:

providing a first chamber surrounding said combustion zone and holes in said wall;

providing a first gas to said combustion zone through said holes, said holes having a first diameter;

providing a second chamber surrounding said first chamber and providing a plurality of tubes coupling said second chamber to said combustion zone, said tubes passing through said first chamber;

providing a second gas to said combustion zone through said second chamber and said tubes, said tubes having a diameter greater than the diameter of said holes, to thereby equalize the flow velocity and pressure drop of said separate gases as the same enter said combustion zone.

* * * * *